US009234442B2

(12) United States Patent
Hernandez Sanchez et al.

(10) Patent No.: US 9,234,442 B2
(45) Date of Patent: Jan. 12, 2016

(54) STEAM TURBINE SYSTEM AND CONTROL SYSTEM THEREFOR

(71) Applicant: General Electric Company, Schenectady, NY (US)

(72) Inventors: Nestor Hernandez Sanchez, Schenectady, NY (US); Kamlesh Mundra, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 277 days.

(21) Appl. No.: 14/083,954

(22) Filed: Nov. 19, 2013

(65) Prior Publication Data

US 2015/0135713 A1 May 21, 2015

(51) Int. Cl.

| | |
|---|---|
| ***F01K 7/22*** | (2006.01) |
| ***F01K 7/34*** | (2006.01) |
| ***F01K 7/38*** | (2006.01) |
| ***F01K 7/04*** | (2006.01) |
| ***F01K 7/24*** | (2006.01) |

(52) U.S. Cl.

CPC . *F01K 7/345* (2013.01); *F01K 7/04* (2013.01); *F01K 7/22* (2013.01); *F01K 7/24* (2013.01); *F01K 7/38* (2013.01)

(58) Field of Classification Search

CPC ..... F01K 7/345; F01K 7/24; F01K 7/22; F01K 7/04; F01K 7/38

USPC ..... 60/653, 654, 646, 657, 660, 663, 60/677–679

See application file for complete search history.

(56) References Cited

U.S. PATENT DOCUMENTS

| | | | | |
|---|---|---|---|---|
| 2,513,601 | A * | 7/1950 | Traupel | 60/39.183 |
| 2,658,336 | A * | 11/1953 | Traupel | 60/39.183 |
| 3,410,091 | A * | 11/1968 | Frutschi | 376/391 |
| 6,508,206 | B1 | 1/2003 | Rechtman | |
| 7,040,095 | B1 | 5/2006 | Lang | |
| 8,091,361 | B1 * | 1/2012 | Lang | 60/654 |
| 2011/0011088 | A1 * | 1/2011 | Iijima et al. | 60/645 |
| 2012/0151926 | A1 | 6/2012 | Labbe | |

FOREIGN PATENT DOCUMENTS

| | | |
|---|---|---|
| WO | 03062704 A1 | 7/2003 |

* cited by examiner

*Primary Examiner* — Hoang Nguyen

(74) *Attorney, Agent, or Firm* — Ernest G. Cusick; Hoffman Warnick LLC

(57) ABSTRACT

Steam turbine system and control system therefor are provided. In one embodiment, a steam turbine system includes an auxiliary turbine in fluid communication with an IP turbine via an auxiliary turbine inlet conduit branch of an IP exhaust conduit. A heat exchanger system may remove heat from an IP exhaust steam, and may add the removed heat to water flowing through a boiler feed-water conduit to a boiler of the steam turbine system.

14 Claims, 3 Drawing Sheets

STEAM TURBINE SYSTEM AND CONTROL SYSTEM THEREFOR

BACKGROUND OF THE INVENTION

1. Technical Field

The disclosure is related generally to turbine system. More particularly, the disclosure is related to a steam turbine system and a steam turbine control system for the steam turbine system.

2. Related Art

Conventional steam turbine systems are frequently utilized to generate power for electric generators. More specifically, a working fluid, such as steam, is conventionally forced across sets of steam turbine blades, which are coupled to the rotor of the steam turbine system. The force of the working fluid on the blades causes those blades (and the coupled body of the rotor) to rotate. In many cases, the rotor body is coupled to the drive shaft of a dynamoelectric machine such as an electric generator. In this sense, initiating rotation of the steam turbine system rotor can initiate rotation of the drive shaft in the electric generator, and cause that generator to generate an electrical current (associated with power output).

The amount of power generated by the steam turbine during operation, and ultimately the efficiency of the steam turbine, oftentimes stated in the form of 'heat rate', may be dependent upon a plurality of factors. For example, one such factor may include the efficiency of the condenser of the steam turbine system. The condenser may be responsible for receiving exhaust steam that has flowed through the various sections (e.g., high-pressure section, low-pressure section) of the steam turbine system, and converting the exhaust steam to fluid. The fluid may be subsequently converted back to steam and flowed through the various sections of the steam turbine system again. When exhaust steam enters the condenser at an undesirable temperature (e.g., higher than optimum conversion temperature), a portion of the exhaust steam may be removed from or rejected by the condenser in order for the condenser to convert all of the exhaust steam to fluid. The overall efficiency of the steam turbine system may be reduced when a portion of the exhaust steam is rejected by the condenser. To compensate for this loss in efficiency, larger condensers are used in the steam turbine system, such that less exhaust steam having an undesirable temperature may be rejected. However, a larger condenser requires an increased power requirement for operation, and also increases the size of the steam turbine system.

An additional factor that may affect the efficiency of the steam turbine system is the temperature of the fluid prior to reaching the boiler of the steam turbine system. That is, the overall efficiency of the steam turbine system may be directly affected by the temperature of the fluid just prior to the fluid reaching the boiler and subsequently being converted to operational steam. The greater the difference between the actual fluid temperature and a desired conversion temperature, the greater the power requirement for the boiler to convert the fluid to steam. That is, as the difference between the actual fluid temperature and the desired conversion temperature increases, the power required to convert the fluid to steam also increases, increasing the heat rate of the steam turbine system. The power required by the boiler to convert the fluid to steam may be generated from other portions of the steam turbine system, which may result in a decrease in power generated by the steam turbine system, and ultimately may decrease the efficiency of the steam turbine system.

BRIEF DESCRIPTION OF THE INVENTION

A steam turbine system and a steam turbine control system are disclosed. In one embodiment the steam turbine system includes: an auxiliary turbine in fluid communication with an intermediate-pressure (IP) turbine of the steam turbine system via an IP exhaust conduit; and a heat exchanger system coupled to the steam turbine system, the heat exchanger system for removing heat from an IP exhaust steam flowing through the IP exhaust conduit, and adding the removed heat to water flowing through a boiler feed-water conduit to a boiler of the steam turbine system.

A first aspect of the invention includes a steam turbine system comprising: an auxiliary turbine in fluid communication with an intermediate-pressure (IP) turbine of the steam turbine system via an auxiliary turbine inlet conduit branch of an IP exhaust conduit; and a heat exchanger system coupled to the steam turbine system, the heat exchanger system for removing heat from IP exhaust steam flowing through the auxiliary turbine inlet conduit, and adding the removed heat to water flowing through a boiler feed-water conduit to a boiler of the steam turbine system.

A second aspect of the invention includes a steam turbine control system comprising: a diagnostic system configured to: determine a heat rate of the steam turbine system; and modify an amount of heat removed from an intermediate-pressure (IP) steam turbine exhaust steam flowing through an auxiliary turbine inlet conduit and added to a boiler feed-water conduit to a boiler of the steam turbine system by a heat exchanger system to minimize the heat rate of the steam turbine system.

A third aspect of the invention includes a steam turbine system comprising: an auxiliary turbine in fluid communication with an intermediate-pressure (IP) turbine of the steam turbine system via an auxiliary turbine inlet conduit branch of an IP exhaust conduit; a heat exchanger system coupled to the steam turbine system, the heat exchanger system for removing heat from an IP exhaust steam flowing through the auxiliary turbine inlet conduit, and adding the removed heat to water flowing through a boiler feed-water conduit to a boiler of the steam turbine system; and a steam turbine control system including: a diagnostic system operably connected to the heat exchanger system, the diagnostic system configured to: determine a heat rate of the steam turbine system; and modify the amount of heat removed from the IP exhaust steam flowing through the auxiliary turbine inlet conduit and added to the boiler feed-water conduit by the heat exchanger system to minimize the heat rate of the steam turbine system.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
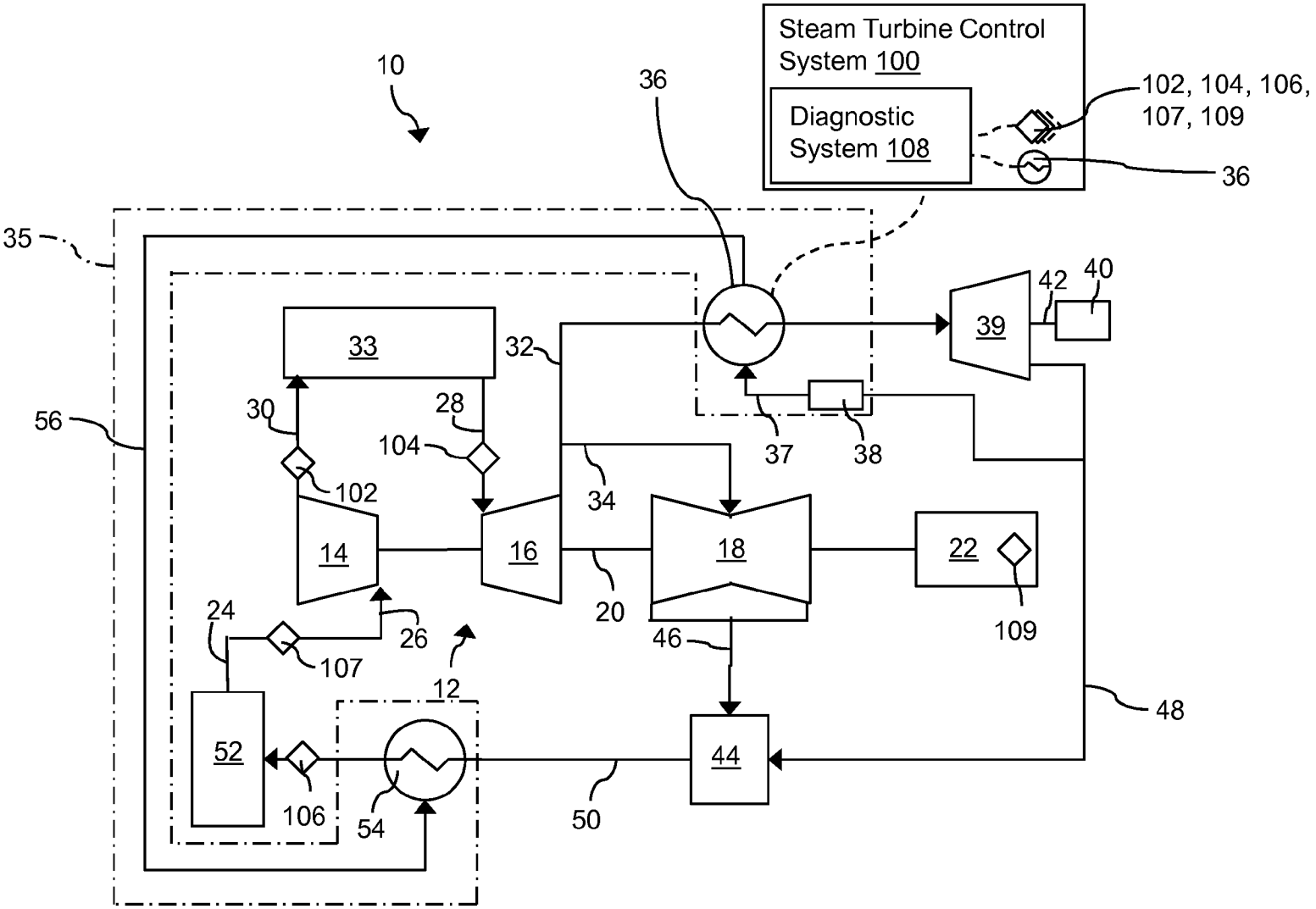
FIG. 1 shows a schematic view of a steam turbine system including a steam turbine control system according to embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As discussed herein, aspects of the invention relate generally to steam turbine systems. More particularly, as discussed herein, aspects of the invention relate to a steam turbine system and a steam turbine control system.

Turning to FIG. 1, a schematic depiction of a steam turbine system 10 is shown according to embodiments of the invention. Steam turbine system 10, as shown in FIG. 1, may be any conventional steam turbine system. As shown in FIG. 1, steam turbine system 10 may include a steam turbine component 12, including a high-pressure (HP) turbine section 14, an intermediate-pressure (IP) turbine section 16 and a low-pressure (LP) turbine section 18. Steam turbine component 12, and specifically the various sections (e.g., HP turbine section 14, etc.), may be coupled to a rotor 20 of steam turbine system 10. Rotor 20 may also be coupled to a generator 22 for creating electricity during operation of steam turbine system 10.

During operation of steam turbine system 10, operational steam may be supplied to steam turbine component 12 via steam inlet conduit 24. More specifically, as shown in FIG. 1, steam inlet conduit 24 may provide operational steam used to rotate the various stages of buckets (not shown) included in HP turbine section 14 and IP turbine section 16 of steam turbine component 12. As shown in FIG. 1, steam inlet conduit 24 becomes HP inlet conduit 26, which provides operational steam to HP turbine section 14. After exhausting HP turbine section 14 via HP exhaust conduit 30, steam may be heated to increase its temperature in reheater 33 and supplied to IP inlet conduit 28 to provide operational steam to IP turbine section 16. As shown in FIG. 1, HP turbine section 14 may include an HP exhaust conduit 30, which may provide HP exhaust steam to the reheater to increase its temperature then to the IP inlet 28.

IP turbine section 16 may include an IP exhaust conduit for moving IP exhaust steam out of IP turbine section 16 of steam turbine component 12. As shown in FIG. 1, IP exhaust flow divides into an auxiliary turbine inlet conduit 32 and an LP inlet conduit 34. LP inlet conduit 34 may be in fluid communication with LP turbine section 18 of steam turbine component 12 to provide steam to cause LP turbine section 18 to rotate the various stages of buckets (not shown) included in LP turbine section 18 of steam turbine component 12. That is, the IP exhaust steam of IP turbine section 16 may flow through LP inlet conduit 34, such that a portion of the IP exhaust steam may flow directly to LP turbine section 18 via LP inlet conduit 34 to make LP turbine section 18 operational.

As shown in FIG. 1, steam turbine system 10 may also include a heat exchanger system 35 (phantom box) coupled to steam turbine system 10. Heat exchanger system 35 may include a first heat exchanger 36 positioned within auxiliary turbine inlet conduit 32, and may be positioned in series, downstream of LP inlet conduit 34 for LP turbine section 18 of steam turbine component 12. As a result of first heat exchanger 36 of heat exchanger system 35 being positioned downstream of LP inlet conduit 34, the portion of IP exhaust steam flowing to LP turbine section 18 may maintain its temperature (e.g., unaffected by first heat exchanger 36) as the IP exhaust steam flows through auxiliary turbine inlet conduit 32 to LP inlet conduit 34. A distinct portion of IP exhaust steam may not flow to LP turbine section 18 via LP inlet conduit 34, and may flow through first heat exchanger 36 of heat exchanger system 35 positioned within auxiliary turbine inlet conduit 32. As discussed herein, first heat exchanger 36 may remove heat from the IP exhaust steam flowing through auxiliary turbine inlet conduit 32, and may add the removed heat to distinct components or portions of steam turbine system 10.

It is understood that first heat exchanger system 36 of heat exchanger system 35, as shown in FIG. 1, may include any conventional heat exchanger component capable of increasing and/or decreasing a temperature of a working fluid (e.g., IP exhaust steam) flowing through first heat exchanger 36. First heat exchanger 36 may include an inlet conduit 37 used to supply heat transmitting fluid to first heat exchanger 36, where the heat transmitting fluid may be utilized to remove heat from IP exhaust steam flowing through auxiliary turbine inlet conduit 32, as discussed herein. Additionally, as discussed herein, the heat transmitting fluid, used to remove heat from IP exhaust steam may be further utilized by heat exchanger system 35 to add the removed heat to distinct components or portions of steam turbine system 10. As is conventionally known, the amount of heat removed from IP exhaust steam via the heat transmitting fluid may be regulated by a regulating component 38. More specifically, as shown in FIG. 1, regulating component 38 may be positioned within inlet conduit 37 and may be capable of regulating the amount of heat removed from the IP exhaust steam. In an embodiment, regulating component 38 may be a valve configured to regulate how much heat transmitting fluid may flow through inlet conduit 37, which may ultimately regulate how much heat may be removed from IP exhaust steam flowing through auxiliary turbine inlet conduit 32, as discussed herein. In an alternative embodiment, regulating component 38 may be configured as a pump configured to regulate the flow rate of the heat transmitting fluid flow through inlet conduit 37, which may regulate how much heat may be removed from IP exhaust steam flowing through auxiliary turbine inlet conduit 32. In a further embodiment, regulating component 38 may be configured as an auxiliary cooler system configured to further cool or decrease the temperature of the heat transmitting fluid flow through inlet conduit 37, which may also regulate how much heat may be removed from IP exhaust steam flowing through auxiliary turbine inlet conduit 32.

Auxiliary turbine inlet conduit 32 may also fluidly couple IP turbine section 16 of steam turbine component 12 to an auxiliary turbine 39 of steam turbine system 10. That is, steam turbine system 10 may include auxiliary turbine 39 in fluid communication with IP turbine section 16 via auxiliary turbine inlet conduit 32. As shown in FIG. 1, auxiliary turbine 39 may be positioned in series, downstream of first heat exchanger 36 of heat exchanger system 35, such that IP exhaust steam may flow through first heat exchanger 36, via auxiliary turbine inlet conduit 32, before the IP exhaust steam flows to auxiliary turbine 39. The distinct portion of the IP exhaust steam flowing through auxiliary turbine inlet conduit 32 to auxiliary turbine 39 may be used to rotate the various stages of buckets (not shown) included in auxiliary turbine 39. As shown in FIG. 1, auxiliary turbine 39 may be coupled directly to a condensate pump 40 (or other ancillary pump(s)) via drive shaft 42 as is typical in fossil and nuclear power plants. The term "auxiliary" indicates that auxiliary turbine 39 does not add to the power input to the main load, e.g., generator 22.

Steam turbine system 10, as shown in FIG. 1, may also include a condenser 44 in fluid communication with LP turbine section 18 of steam turbine component 12. More specifically, an LP exhaust conduit 46 may be positioned between LP turbine section 18 and condenser 44, such that condenser 24 may be in fluid communication with LP turbine section 18 via LP exhaust conduit 46. As discussed herein, LP exhaust conduit 46 may be utilized to flow LP exhaust steam exiting LP turbine section 18 to condenser 44 for further processing (e.g., condensation process). As shown in FIG. 1, condenser 44 may also be in fluid communication with auxiliary turbine 39 via auxiliary exhaust conduit 48. That is, condenser 44 and auxiliary turbine 39 may be in fluid communication, such that auxiliary exhaust steam of auxiliary turbine 39 may be provided to condenser 44 via auxiliary exhaust conduit 48. The auxiliary exhaust steam of auxiliary turbine 39 may be combined with the LP exhaust steam of LP turbine section 18 within condenser 44. Condenser 44 may receive the exhaust steam from auxiliary turbine 39 and LP turbine section 18, and may condense the combined exhaust steam to form water, which may be subsequently converted to operational steam to be provided to steam turbine component 12 of steam turbine system 10. As an option, auxiliary turbine exhaust may be connected to an auxiliary condenser (not shown), rather than condenser 44, and the output thereof may be combined with that of condenser 44.

Steam turbine system 10 may also include a boiler feed-water conduit 50 fluidly coupling condenser 44 with a boiler 52. More specifically, as shown in FIG. 1, condenser 44 may be in fluid communication with boiler 52 via boiler feed-water conduit 50. An inlet to boiler 52 may be referred to herein as the final feedwater (ffw) location. Boiler 52 may also be in fluid communication with steam turbine component 12 via steam inlet conduit 24. That is, steam inlet conduit 24 may fluidly couple boiler 52 to HP inlet conduit 26 for providing operational steam to HP turbine section 14 of steam turbine component 12. Boiler feed-water conduit 50 may move water formed in condenser 44 to boiler 52 in order for boiler 52 to convert the water to operational steam for turbine component 12. That is, during operation of steam turbine system 10, the water formed by condenser 44 may flow to boiler 52 via boiler feed-water conduit 50, and boiler 52 may subsequently heat the water to form operational steam for steam turbine component 12.

As shown in FIG. 1, heat exchanger system 35 may also include a second heat exchanger 54 positioned within boiler feed-water conduit 50 fluidly coupling condenser 44 and boiler 52. That is, second heat exchanger 54 may be positioned within boiler feed-water conduit 50, and may be positioned between condenser 44 and boiler 52, such that the water of condenser 44 may flow through second heat exchanger 54 before flowing to boiler 52. Second heat exchanger 54 may include an open or a closed heater. As shown in FIG. 1, second heat exchanger 54 of heat exchanger system 35 may be in fluid communication with first heat exchanger 36 via a heat exchanger conduit 56 of heat exchanger system 35. More specifically, heat exchanger conduit 56 of heat exchanger system 35 may fluidly couple first heat exchanger 36 and second heat exchanger 54, such that the heat removed from the IP exhaust steam by first heat exchanger 36 may be provided to second heat exchanger 54 via heat exchanger conduit 56. As discussed herein, the heat removed from the IP exhaust steam may be provided to second heat exchanger 54 by flowing the heat transmitting fluid from first heat exchanger 36 to second heat exchanger 54 via heat exchanger conduit 56. As a result of receiving the removed heat from first heat exchanger 36, second heat exchanger 54 may add the removed heat from the IP exhaust steam to the water flowing through boiler feed-water conduit 50 prior to the water flowing to boiler 52. That is, during operation of steam turbine system 10, first heat exchanger 36 may remove heat from the IP exhaust steam flowing through auxiliary turbine inlet conduit 32, and first heat exchanger 36 may provide the removed heat to second heat exchanger 54 via heat exchanger conduit 56. Second heat exchanger 54 may subsequently utilize the removed heat from the IP exhaust steam to heat or substantially increase the temperature of the water flowing to boiler 52 via boiler feed-water conduit 50, improving the efficiency of steam turbine system 10. In an alternative embodiment, if plant configuration allows, a single heat exchanger may be employed. In this case, heat exchanger 36 may be removed and auxiliary turbine input conduit 32 may be routed to a single heat exchanger 54 in boiler feed-water conduit 50 then back to the inlet of auxiliary turbine 39.

By allowing second heat exchanger 54 of heat exchanger system 35 to increase the temperature of the water using the removed heat from the IP exhaust steam, boiler 52 may not require as much energy or power to convert the water to operational steam for steam turbine component 12, as discussed herein. That is, by utilizing the removed heat from the IP exhaust steam of IP turbine section 18, the water entering boiler 52 may have a temperature that is substantially higher than the temperature of the water as it immediately flows from condenser 44 into boiler feed-water conduit 50. As a result, the temperature of the water entering boiler 52 may be substantially equal to or slightly higher than a temperature for converting the water to operational steam, which may ultimately allow boiler 52 to convert the water to operational steam at a reduced energy or power requirement, reducing the heat rate of steam turbine system 10.

As shown in FIG. 1, steam turbine system 10 may also include steam turbine control system 100 (hereafter, "control system 100"). Control system 100 may include a plurality of sensors (e.g., a first sensor 102, a second sensor 104, a third sensor 106, and a fourth sensor 107) operably connected to diagnostic system 108 (e.g., via wireless, hardwire, or other conventional means). More specifically, control system 100 may include: a first sensor 102 operably connected to diagnostic system 108; a second sensor 104 operably connected to diagnostic system 108; a third sensor 106 operably connected to diagnostic system 108; and diagnostic system 108; and a fourth sensor 107 operably connected to diagnostic system 108. In addition, control system may include a power sensor 109 at generator 22 operably connected to diagnostic system 108 (e.g., via wireless, hardwire, or other conventional means). Each sensor 102, 104, 106, 107 may be any conventional device capable of obtaining or sensing a particular parameter or a number of parameters such as but not limited to mass flow, pressure and temperature. As such, each sensor 102, 104, 106, 107 may employ a single, multiple measurement sensor or a number of component sensors for each parameter to be measured. For example, one or more of the plurality of sensors may include one or more of: thermometers, thermocouples, thermistors, pyrometers, infrared sensors, flow meters, pressure measuring systems, etc.

As shown in FIG. 1, first sensor 102 may be positioned within HP turbine section 14 exhaust conduit 30; second sensor 104 may be positioned within IP turbine section 16 inlet conduit 28; third sensor 106 may be positioned at the final feedwater (ffw) location at the inlet to boiler 52; and fourth sensor 107 may be positioned in HP inlet conduit 26. As noted, each sensor 102, 104, 106, 107 may sense a particular parameter or a number of parameters including but not limited to: mass flow, pressure and temperature. More specifically, first sensor 102 may sense any of the listed parameters of HP turbine section exhaust steam flowing through exhaust conduit 30 and may provide the measurements of the exhaust steam to diagnostic system 108 of control system 100. Second sensor 104 may sense any of the listed parameters of IP turbine section inlet steam flowing through IP section inlet conduit 28 and may provide the measurements of the inlet steam to diagnostic system 108 of control system 100. Third sensor 106 may sense any of the listed parameters of the water flowing through the inlet of boiler 52 and may provide the measurements of the water to diagnostic system 108 of control system 100. Fourth sensor 107 may sense any of the listed parameters of HP turbine section inlet steam flowing through HP section inlet conduit 26 and may provide the measurements of the inlet steam to diagnostic system 108 of control system 100. Similarly, power sensor 109 may sense a power output (kW) of generator 22 and may provide the measurements of the power to diagnostic system 108 of control system 100. Each measurement may be made by sensors 102, 104, 106, 107, 109 continuously or may be made at predetermined intervals. Additionally, each sensor may continuously provide the sensed parameters to diagnostic system 108, or may provide the sensed parameters at predetermined intervals.

As shown in FIG. 1, control system 100 may include diagnostic system 108 operably connected to the plurality of sensors (e.g., first sensor 102, second sensor 104, etc.) of control system 100. More specifically, diagnostic system 108 may be operably connected (e.g., via wireless, hardwire, or other conventional means) to: first sensor 102, second sensor 104, third sensor 106, fourth sensor 107 and power sensor 109. Additionally, as shown in FIG. 1, diagnostic system 108 of control system 100 may be operably connected to heat exchanger system 35. More specifically, diagnostic system 108 may be operably connected to first heat exchanger 36 and/or second heat exchanger 54 of heat exchanger system 35.

As discussed herein, diagnostic system 108 of control system 100 may be configured to determine a heat rate of steam turbine system 10, and modify the amount of heat removed from the IP exhaust steam flowing through auxiliary turbine inlet conduit 32 and added to boiler feed-water conduit 50 by heat exchanger system 35 to minimize the heat rate (i.e., increase the efficiency) of the steam turbine system. As discussed herein, diagnostic system 108 of control system 100 may be configured to modify the heat exchanger system 35 to one of increase or decrease the amount of heat removed from the IP exhaust steam flowing through auxiliary turbine inlet conduit 32 in response to the heat rate of the steam turbine system increasing.

Figure 2:
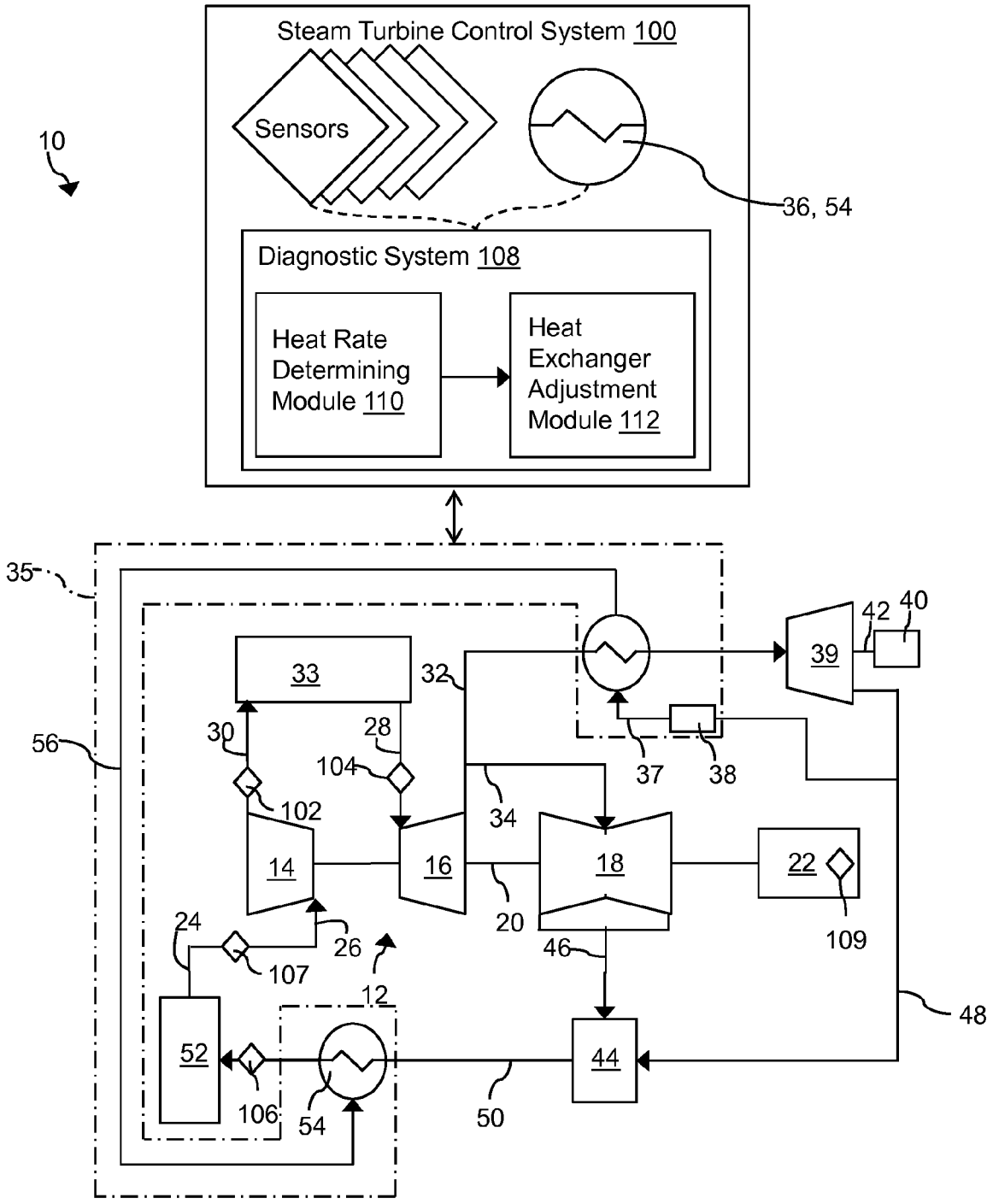
FIG. 2 shows a schematic depiction of a steam turbine control system of FIG. 1 including a diagnostic system according to embodiments of the invention.

Turning to FIG. 2, a schematic depiction of control system 100 including diagnostic system 108 is shown according to embodiments of the invention. In the Figures, it is understood that similarly numbered components may function in a substantially similar fashion. Redundant explanation of these components has been omitted for clarity. As shown in FIG. 2, diagnostic system 108 of control system 100 may include a heat rate determining module 110 (hereafter, "heat rate module 110"), and a heat exchanger adjustment module 112 (hereafter, "adjustment module 112"). Heat rate module 110 may be communicatively connected to adjustment module 112. Diagnostic system 108 of control system 100 may be communicatively connected to the plurality of sensors (e.g., first sensor 102, second sensor 104, etc.) and may be configured to receive data relating to, for example, the mass flow, temperature, pressure, etc., of the various flows sensed by the plurality of sensors of control system 100. As understood in the art, a wide variety of other sensors (i.e., temperature, pressure, flow rate, rotational speed, etc.) may also be accessed by diagnostic system 108.

Figure 3:
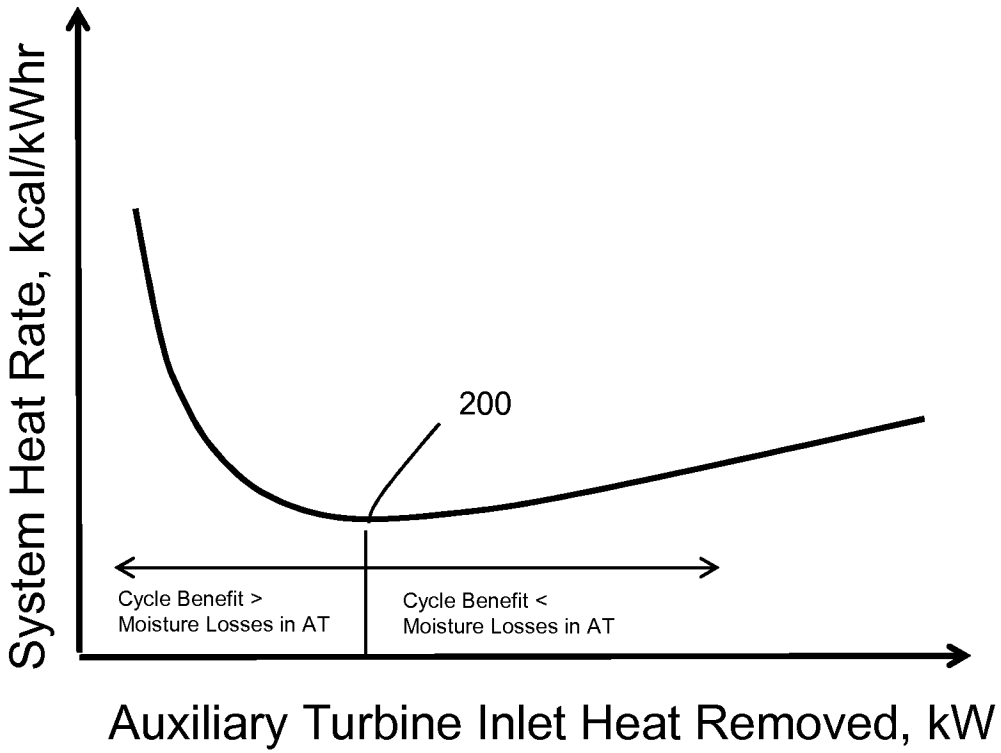
FIG. 3 shows a graphical representation of a correlation between steam turbine system heat rate and heat removed from IP exhaust steam for an auxiliary turbine according to embodiments of the invention.

Referring to FIG. 3, an illustrative graphical correlation between steam turbine system heat rate (vertical axis) (e.g., in kcal/kWhr) versus auxiliary turbine inlet heat removed (e.g., in kW) (and added to boiler feed water) is shown. A minimum heat rate (i.e., highest efficiency) point 200 corresponds to the bottom of the chart at a given operating condition. As illustrated in the graph, where an amount of heat removed is below point 200, feed-water cycle benefits are greater than moisture losses in auxiliary turbine 39, resulting in heat rate increases (i.e., loss of efficiency). In contrast, where heat removed exceeds point 200, feed-water cycle benefits are less than the moisture losses in auxiliary turbine 39, also resulting in heat rate increases (i.e., loss of efficiency). Consequently, diagnostic system 108 aims to balance feed-water cycle effects versus moisture losses in auxiliary turbine 39 to minimize heat rate of steam turbine system 10. More specifically, heat rate module 110 of diagnostic system 108, as shown in FIG. 2, may be configured to obtain or receive data from the plurality of sensors, and perhaps many other sensors about system 10), and may be configured to calculate a heat rate of steam turbine system 100 according to any now known or later developed methodology. In one example, heat rate (HR) may be determined according to the following formula:

$$HR=(m_HP_inlet*(H_HP_inlet-H_ffw)+m_IP_inlet*(H_IP_inlet-H_HP_exh))/GEN\ kW,$$

where m_HP_inlet is mass flow of inlet steam to HP turbine section 14, H_HP_inlet is enthalpy of inlet steam to HP turbine section 14, H_ffw is enthalpy of inlet water at the final feedwater (ffw) location at the inlet to boiler 52, m_IP_inlet is mass flow of inlet steam to IP turbine section 16, H_IP_inlet is enthalpy of inlet steam to IP turbine section 16, H_HP_exh is enthalpy of exhaust steam from HP turbine section 14, and GEN kW is the power output of generator 22. Based on the foregoing, heat rate is determined using pressure and temperature measurements in the dry region of the steam turbine (i.e. HP and IP sections) along with measured generator output.

With continuing reference to FIG. 2, mass flow of inlet steam to HP turbine section 14 (m_HP_inlet) is measured by third sensor 107, i.e., in the form of a flow meter. Enthalpy of inlet steam to HP turbine section 14 (H_HP_inlet) is calculated by heat rate module 110 based on pressure and temperature measurements of HP turbine section inlet steam by third sensor 107 using any now known or later developed technique. Enthalpy of inlet water at the final feedwater (ffw) location at the inlet to boiler 52 (H_ffw) is calculated by heat rate module 110 based on pressure and temperature measurements by third sensor 106 using any now known or later developed technique. Mass flow of inlet steam to IP turbine section 16 (m_IP_inlet) is measured by second sensor 104, i.e., in the form of a flow meter. Enthalpy of inlet steam to IP turbine section 16 (H_IP_inlet) is calculated by heat rate module 110 based on pressure and temperature measurements of IP turbine section inlet steam by second sensor 104 using any now known or later developed technique. And, enthalpy of exhaust steam from HP turbine section 14 (H_HP_exh) is calculated by heat rate module 110 based on pressure and temperature measurements of HP turbine section exhaust steam by first sensor 101 using any now known or later developed technique. It is understood that other formulation of heat rate may be employed and the related sensor measurements altered accordingly to determine the appropriate parameters to carry out such alternative heat rate formulations.

In addition to determining heat rate, heat rate module 110 may also determine whether a heat rate of the steam turbine system 10 is increasing, i.e., relative to a previously calculated heat rate. Adjustment module 112 may be configured to adjust heat exchanger system 35 (e.g., via control valves and other equipment) to modify the amount of heat removed from auxiliary turbine inlet conduit 32 and added to boiler feedwater conduit 50, i.e., to water flowing through the conduit to boiler 52. More specifically, adjustment module 112 may be configured to determine how to adjust heat exchanger system 35, i.e., increase or decrease heat removal.

Adjustment module 112 of diagnostic system 108 may be configured to receive or obtain an indicator from heat rate module 110 in response to determining that the heat rate has increased or decreased, i.e., from a previously calculated heat rate, and may modify heat exchanger system 35 accordingly. More specifically, adjustment module 112 of diagnostic system 108 may receive or obtain the indicator from heat rate module 110 and may modify first heat exchanger 36 and/or second heat exchanger 54 of heat exchanger system 35 to increase or decrease the amount of heat removed from the IP exhaust steam flowing through auxiliary turbine inlet conduit 32. Adjustment module 112 may modify the amount of heat transmitting fluid used in first heat exchanger 36 and/or second heat exchanger 54 of heat exchanger system 35 to increase or decrease the amount of heat removed/added from the IP exhaust steam flowing through auxiliary turbine inlet conduit 32. For example, and as discussed herein, adjustment module 112 of diagnostic system 108 may be operably connected to a regulating component 38 of first heat exchanger 36, and may send an electronic signal to regulating component 38 of first heat exchanger 36 to modify regulating component 38. Regulating component 38 may be an adjustable valve positioned within inlet conduit 37, where heat rate module 112 may modify a position (e.g., open, closed, partially open) of the valve forming regulating component 38. In modifying the position of regulating component 38 of first heat exchanger 36, adjustment module 112 may modify the amount of heat transmitting fluid supplied to first heat exchanger 36, which may ultimately increase or decrease the amount of heat removed from IP exhaust steam flowing through first heat exchanger 36 via auxiliary turbine inlet conduit 32. Similar structure and functioning may be employed with second heat exchanger 54.

As discussed herein with respect to heat rate module 110, adjustment module 112 may be configured to modify heat exchanger system 35 to increase or decrease the amount of heat removed from the IP exhaust steam based, at least in part, upon operational characteristics of steam turbine system 10 that impact heat rate, and the operational characteristics of auxiliary turbine 39, which may determine the anticipated heat transfer or heat loss, adjustment module 112 may modify first heat exchanger 36 of heat exchanger system 35 to increase or decrease the amount of heat removed from the IP exhaust steam. Additionally, the heat transfer or heat loss may be calculated using a conventional heat transfer equation, the determined temperature of the auxiliary exhaust steam and knowing the operational characteristics of auxiliary turbine 39. As discussed herein, the operational characteristics of auxiliary turbine 39 that may aid in determining the heat transfer or heat loss in auxiliary turbine 39 may include, but are not limited to: the size of auxiliary turbine 39, the power output of auxiliary turbine 39, the temperature of the IP exhaust steam flowing through auxiliary turbine 39, etc. A number of examples of diagnostic system 108 operation will now be described. In an embodiment, where heat rate module 110 determines heat rate is increasing, adjustment module 112 may modify first exchanger 36 of heat exchanger system 35 to increase the amount of heat removed from IP exhaust steam. Adjustment module 112 may modify the position of regulating component 38 of first heat exchanger 36 to increase the amount of heat removed from the IP exhaust steam flowing through auxiliary turbine inlet conduit 32. Adjustment module 112 may modify first heat exchanger 36 of heat exchanger system 35 to increase the amount of heat removed from the IP exhaust steam by modifying the position of regulating component 38 of first heat exchanger 36 to be open or partially open. Where regulating component 38 is substantially open, a maximum amount of heat transmitting fluid of first heat exchanger 36 may be provided to first heat exchanger 36 to substantially cool IP exhaust steam flowing through auxiliary turbine inlet conduit 32 prior to the IP exhaust steam flowing through auxiliary turbine 39.

By utilizing heat exchanger system 35 and/or control system 100, as discussed herein, heat rate may be minimized. As a result, condenser 44 may substantially decrease or eliminate the amount of auxiliary exhaust steam rejected during operation of steam turbine system 10. The decrease or elimination of rejected auxiliary exhaust steam may ultimately increase the efficiency of condenser 44 and also minimize heat rate, i.e., increase the overall operational efficiency of steam turbine system 10. Also, by decreasing or eliminating the rejection of a portion of the auxiliary exhaust steam, condenser 44 of steam turbine system 10 may be smaller in size, which may also decrease the overall size or space requirement for steam turbine system 10. Furthermore, where the size of condenser 44 may be reduced as a result of utilizing heat exchanger system 35 and/or control system 100, the costs associated with condenser 44 (e.g., manufacturing, transporting, installation) may also be reduced. Additionally, in utilizing heat exchanger system 35 and/or control system 100, and more specifically, removing and adding heat to the water of the steam turbine system 10 via heat exchanger system 35, boiler 52 of steam turbine system 10 may heat the water and/or convert it to operational steam more quickly and/or with a decreased power requirement. As a result, boiler 52 may also become more efficient during operation, which may also increase the overall operational efficiency of steam turbine system 10.

Diagnostic system 108, and its respective components (e.g., heat rate module 110, adjustment module 112), may be configured as any conventional data processing system (e.g., computer system, hard drives) capable of receiving, temporarily storing and transmitting/forwarding data and signals within the system and to external components coupled to the system (e.g., first heat exchanger 36). More specifically, diagnostic system 108 of control system 100 may be configured as any conventional hardware device (computer system controller), and the components of diagnostic system 108 (e.g., heat rate module 110, adjustment module 112) may be configured as software components stored within said computer system forming diagnostic system 108. In an example embodiment, diagnostic system 108 may be configured as a circuit board implemented on a conventional computer system, and may include associated software for performing the operational functions discussed herein. Additionally, it is understood that control system 100 may also be included in a control system (not shown) for the entire steam turbine system 10. That is, control system 100, as discussed herein, may be included within the control system configured to operate steam turbine system 10 and its various components (e.g., turbine component 12, condenser 44, boiler 52, etc.).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine system comprising:

an auxiliary turbine in fluid communication with an intermediate-pressure (IP) turbine of the steam turbine system via an auxiliary turbine inlet conduit branch of an IP exhaust conduit; and a heat exchanger system coupled to the steam turbine system, the heat exchanger system for removing heat from IP exhaust steam flowing through the auxiliary turbine inlet conduit, and adding the removed heat to water flowing through a boiler feed-water conduit to a boiler of the steam turbine system.

2. The steam turbine system of claim 1, wherein the heat exchanger system includes:

a first heat exchanger positioned within the auxiliary turbine inlet conduit, the first heat exchanger for removing the heat from the IP exhaust steam flowing through the auxiliary turbine inlet conduit; and a second heat exchanger positioned within the boiler feed-water conduit, the second heat exchanger for adding the removed heat to the water flowing through the boiler feed-water conduit.

3. The steam turbine system of claim 2, wherein the first heat exchanger of the heat exchanger system is in fluid communication with the second heat exchanger of the heat exchanger system via a heat exchanger conduit.

4. The steam turbine system of claim 1, further comprising:

a low-pressure (LP) turbine; and a condenser in fluid communication with the LP turbine via an LP exhaust conduit, the condenser in fluid communication with the boiler via the boiler feed-water conduit.

5. The steam turbine system of claim 4, wherein the condenser is in fluid communication with the auxiliary turbine via an auxiliary turbine exhaust conduit.

6. The steam turbine system of claim 5, further comprising a steam turbine control system including:

a diagnostic system configured to:

determine a heat rate of the steam turbine system; and modify the amount of heat removed from the IP exhaust steam flowing through the auxiliary turbine inlet conduit and added to the boiler feed-water conduit by the heat exchanger system to minimize the heat rate of the steam turbine system.

7. The steam turbine system of claim 6, wherein the heat exchanger system is operably connected to the diagnostic system.

8. A steam turbine control system comprising:

a diagnostic system configured to:

determine a heat rate of the steam turbine system; and modify an amount of heat removed from an intermediate-pressure (IP) steam turbine exhaust steam flowing through an auxiliary turbine inlet conduit and added to a boiler feed-water conduit to a boiler of the steam turbine system by a heat exchanger system to minimize the heat rate of the steam turbine system.

9. The steam turbine control system of claim 8, wherein the heat exchanger system is in fluid communication with the auxiliary turbine inlet conduit, the heat exchanger system for removing heat from the IP exhaust steam flowing through the auxiliary turbine inlet conduit, and adding the removed heat to water flowing through the boiler feed-water conduit to the boiler of the steam turbine system.

10. The steam turbine control system of claim 8, wherein the heat exchanger system includes:

a first heat exchanger positioned within the auxiliary turbine inlet conduit, the first heat exchanger for removing the heat from the IP exhaust steam flowing through the auxiliary turbine inlet conduit; and a second heat exchanger positioned within the boiler feed-water conduit, the second heat exchanger for adding the removed heat to the water flowing through the boiler feed-water conduit.

11. The steam turbine control system of claim 10, wherein the first heat exchanger of the heat exchanger system is in fluid communication with the second heat exchanger of the heat exchanger system via a heat exchanger conduit.

12. The steam turbine control system of claim 8, wherein the heat exchanger system is operably connected to the diagnostic system.

13. A steam turbine system comprising:

an auxiliary turbine in fluid communication with an intermediate-pressure (IP) turbine of the steam turbine system via an auxiliary turbine inlet conduit branch of an IP exhaust conduit;

a heat exchanger system coupled to the steam turbine system, the heat exchanger system for removing heat from an IP exhaust steam flowing through the auxiliary turbine inlet conduit, and adding the removed heat to water flowing through a boiler feed-water conduit to a boiler of the steam turbine system; and a steam turbine control system including:

a diagnostic system operably connected to the heat exchanger system, the diagnostic system configured to:

determine a heat rate of the steam turbine system; and modify the amount of heat removed from the IP exhaust steam flowing through the auxiliary turbine inlet conduit and added to the boiler feed-water conduit by the heat exchanger system to minimize the heat rate of the steam turbine system.

14. The steam turbine system of claim 13, wherein the heat exchanger system includes:

a first heat exchanger in fluid communication with the auxiliary turbine inlet conduit, the first heat exchanger for removing the heat from the IP exhaust steam flowing through the auxiliary turbine inlet conduit; and a second heat exchanger positioned within the boiler feed-water conduit, the second heat exchanger for adding the removed heat to the water flowing through the boiler feed-water conduit.

* * * * *